US011087915B2

(12) United States Patent
Nakajima et al.

(10) Patent No.: US 11,087,915 B2
(45) Date of Patent: Aug. 10, 2021

(54) ELECTRONIC COMPONENT AND MANUFACTURING METHOD THEREOF

(71) Applicant: TDK CORPORATION, Tokyo (JP)

(72) Inventors: Masahiro Nakajima, Tokyo (JP); Kenichi Hirenzaki, Tokyo (JP); Makoto Endo, Tokyo (JP); Masanori Suzuki, Tokyo (JP); Tomonaga Nishikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 349 days.

(21) Appl. No.: 16/100,607

(22) Filed: Aug. 10, 2018

(65) Prior Publication Data

US 2019/0066900 A1 Feb. 28, 2019

(30) Foreign Application Priority Data

Aug. 28, 2017 (JP) ..... 2017-162944

(51) Int. Cl.
*H01F 27/29* (2006.01)
*H01F 27/24* (2006.01)
(Continued)

(52) U.S. Cl.
CPC ..... *H01F 27/24* (2013.01); *H01F 17/00* (2013.01); *H01F 17/0013* (2013.01); *H01F 17/04* (2013.01); *H01F 27/28* (2013.01); *H01F 27/2804* (2013.01); *H01F 27/29* (2013.01); *H01F 27/292* (2013.01); *H01F 27/32* (2013.01); *H01F 41/04* (2013.01); *H01F 41/041* (2013.01);
(Continued)

(58) Field of Classification Search
CPC ..... H01F 27/24; H01F 27/292; H01F 27/28; H01F 17/04; H01F 17/00; H01F 41/04; H01F 41/046; H01F 17/0013; H01F 41/12; H01F 27/2804; H01F 41/127; H01F 27/32; H01F 41/041; H01F 27/29; H01F 2017/048
See application file for complete search history.

(56) References Cited

U.S. PATENT DOCUMENTS 6,373,368 B1 * 4/2002 Shikama ..... H01F 27/027 336/200
6,459,048 B1 10/2002 Sakai et al.
(Continued)

FOREIGN PATENT DOCUMENTS

JP 3-145812 A 6/1991
JP 2011014747 A 1/2011
(Continued)

*Primary Examiner* — Tuyen T Nguyen
(74) *Attorney, Agent, or Firm* — Young Law Firm, P.C.

(57) ABSTRACT

Disclosed herein is an electronic component that includes: a base having a main surface; a passive element part formed on the main surface of the base; a magnetic resin layer formed on the main surface of the base so as to embed the passive element part therein, the magnetic resin layer having a surface extending substantially parallel to the main surface of the base; an insulating coat layer formed on a first area of the surface of the magnetic resin layer, the insulating coat layer having higher smoothness than the surface of the magnetic resin layer; and a terminal electrode formed on a second area of the surface of the magnetic resin layer and electrically connected to the passive element part.

13 Claims, 10 Drawing Sheets

(51) Int. Cl.

| | |
|---|---|
| ***H01F 27/28*** | (2006.01) |
| ***H01F 41/12*** | (2006.01) |
| ***H01F 27/32*** | (2006.01) |
| ***H01F 41/04*** | (2006.01) |
| ***H01F 17/04*** | (2006.01) |
| ***H01F 17/00*** | (2006.01) |

(52) U.S. Cl.
CPC ..... *H01F 41/046* (2013.01); *H01F 41/12* (2013.01); *H01F 41/127* (2013.01); *H01F 2017/048* (2013.01)

(56) References Cited

U.S. PATENT DOCUMENTS

| | | | | |
|---|---|---|---|---|
| 2010/0157565 | A1 | 6/2010 | Yoshida et al. | |
| 2013/0222101 | A1* | 8/2013 | Ito | H01F 5/003 336/83 |
| 2014/0028430 | A1* | 1/2014 | Lee | H01F 17/0013 336/200 |
| 2016/0260535 | A1 | 9/2016 | Kubota et al. | |
| 2016/0314890 | A1 | 10/2016 | Kitajima et al. | |
| 2017/0200554 | A1 | 7/2017 | Kudo et al. | |

FOREIGN PATENT DOCUMENTS

| | | | |
|---|---|---|---|
| JP | 2011-91097 | A | 5/2011 |
| JP | 2017-103360 | A | 6/2017 |

* cited by examiner

ELECTRONIC COMPONENT AND MANUFACTURING METHOD THEREOF

BACKGROUND OF THE INVENTION

Field of the Invention

The present invention relates to an electronic component and a manufacturing method thereof and, more particularly, to an electronic component having a magnetic resin layer embedded with a passive element part and a manufacturing method therefor.

Description of Related Art

A general electronic component often has a structure in which a passive element part is formed on the surface of a base and covered with an insulating material. As described in JP 2011-14747 A, some electronic components requiring high magnetic characteristics, such as coil components, use a magnetic material such as ferrite as the base and a magnetic resin as the insulating material for covering the passive element part. With this configuration, a closed magnetic path is formed by the base and magnetic resin layer, thereby making it possible to obtain high magnetic characteristics.

However, the magnetic resin includes a magnetic filler such as metal magnetic particles, so that it is larger in surface roughness and thus lower in smoothness than a general insulating resin. Thus, in an electronic component of the type described in JP 2011-14747 A in which the magnetic resin layer and the mounting substrate face each other, flow of underfill for filling a gap between the mounting substrate and the electronic component may be blocked.

SUMMARY

It is therefore an object of the present invention to provide an electronic component having a magnetic resin layer embedded with a passive element part and in which underfill easily flows. Another object of the present invention is to provide a manufacturing method of such an electronic component.

An electronic component according to the present invention includes: a base; a passive element part formed on the main surface of the base; a magnetic resin layer formed on the main surface of the base so as to embed the passive element part therein and having a surface extending parallel to the main surface of the base; an insulating coat layer formed on a first area of the surface of the magnetic resin layer and having higher smoothness than the surface of the magnetic resin layer; and a terminal electrode formed on a second area of the surface of the magnetic resin layer and connected to the passive element part.

According to the present invention, the insulating coat layer having high smoothness is formed on the surface of the magnetic resin layer, so that when underfill is supplied to a gap between the mounting substrate and the electronic component which has been mounted on the mounting substrate such that the magnetic resin layer faces the mounting substrate, the underfill can be made to easily flow in the gap. In addition, the terminal electrode is formed on the surface of the magnetic resin layer having large surface roughness, so that adhesion of the terminal electrode is enhanced by anchor effect.

In the present invention, the insulating coat layer may contain insulating resin. This allows an insulating coat layer having high smoothness to be formed by a low-cost process such as a screen printing method. In this case, the insulating coat layer may further contain inorganic filler. This can reduce the thermal expansion coefficient of the insulating coat layer.

In the present invention, the magnetic resin layer may contain metal magnetic particles. This can significantly enhance the permeability of the magnetic resin layer.

In the present invention, the surface of the magnetic resin layer may not be exposed, that is, may be completely covered with the terminal electrode and the insulating coat. With this configuration, the entire surface of the magnetic resin layer having low smoothness is covered, thus making it possible to enhance the flowability of underfill.

In the present invention, the magnetic resin layer may further have a first side surface perpendicular to the main surface of the base, and the terminal electrode may be continuously formed on the surface and the first side surface of the magnetic resin layer. With this configuration, a solder fillet is formed when the electronic component is mounted on the substrate by soldering, thus making it possible to enhance mounting reliability. In this case, the magnetic resin layer may further have a second side surface perpendicular to both the main surface of the base and the first side surface, and the second side surface of the magnetic resin layer may be completely exposed without being covered with the terminal electrode. With this configuration, a process for manufacturing the electronic component can be simplified, thus making it possible to reduce the manufacturing cost.

In the present invention, the terminal electrode may include first and second terminal electrodes, the passive element part may include a coil pattern, and one and the other ends of the coil pattern may be connected respectively to the first and second terminal electrodes. This allows a coil component as an inductance element to be provided. In this case, the terminal electrode may further include a third terminal electrode formed in a third area of the surface of the magnetic resin layer. This can enhance mounting strength and heat radiation performance.

In the present invention, the film thickness of the terminal electrode and that of the insulating coat layer may differ from each other. That is, the film thickness of the terminal electrode and that of the insulating coat layer need not coincide with each other, but they may be individually designed according to required characteristics.

An electronic component manufacturing method according to the present invention includes the steps of: forming a passive element part on the main surface of a base; forming a magnetic resin layer on the main surface of the base so as to embed the passive element part therein; forming an insulating coat layer having higher smoothness than the surface of the magnetic resin layer in a first area of the surface of the magnetic resin layer that is parallel to the main surface of the base; and selectively forming a terminal electrode connected to the passive element part in a second area which is a part of the surface of the magnetic resin layer that is not covered with the insulating coat layer by electroless plating.

According to the present invention, an electronic component in which underfill easily flows can be provided. Further, since the terminal electrode is formed by the electroless plating using the insulating coat layer as a mask, a process of manufacturing the electronic component can be simplified.

In the present invention, a step of polishing the surface of the magnetic resin layer may be performed before the step of forming the terminal electrode. With this process, a magnetic material such as metal magnetic particles is exposed to the surface of the magnetic resin layer, thereby facilitating the formation of the terminal electrode by the electroless plating. In this case, a step of forming a groove in the magnetic resin layer to expose a part of the side surface of the magnetic resin layer and a part of the passive element part may be performed before the step of forming the terminal electrode. Further, in the step of forming the terminal electrode, the terminal electrode may be formed also on the side surface of the magnetic resin layer. This allows the terminal electrode to be formed on the surface and side surface of the magnetic resin layer simultaneously.

As described above, according to the present invention, there can be provided an electronic component in which underfill easily flows and a manufacturing method therefor.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

First Embodiment

Figure 1:
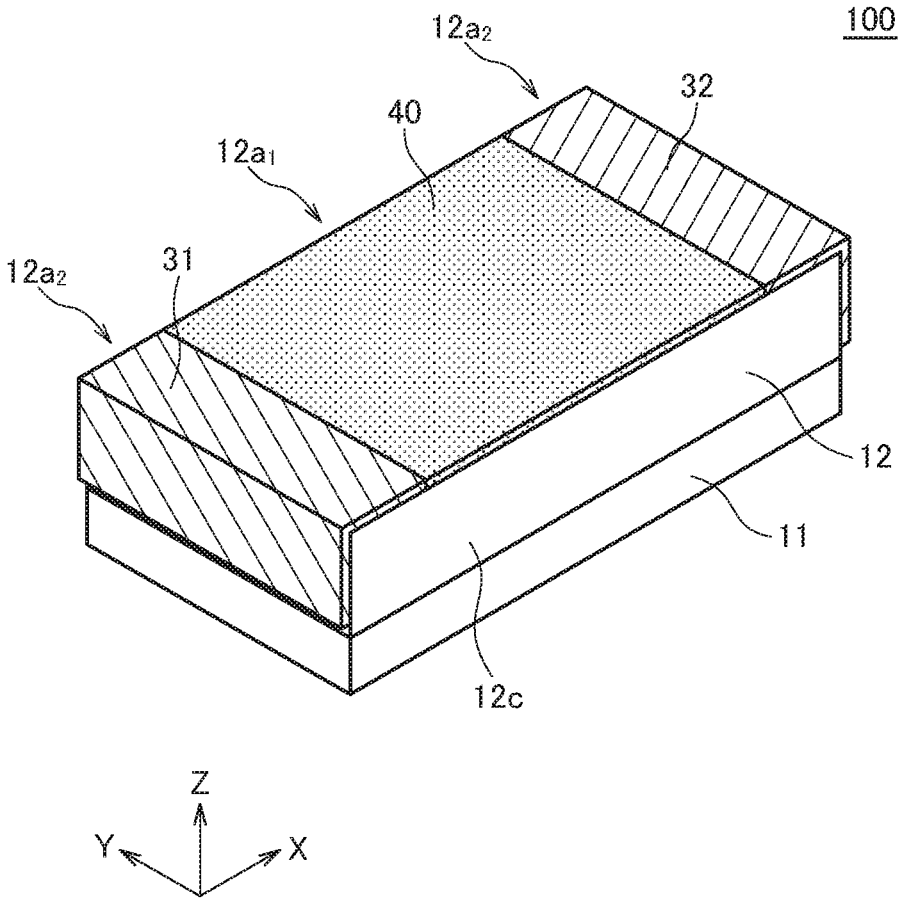
FIG. 1 is a schematic perspective view illustrating the outer appearance of an electronic component according to a first embodiment of the present invention.
Figure 2:
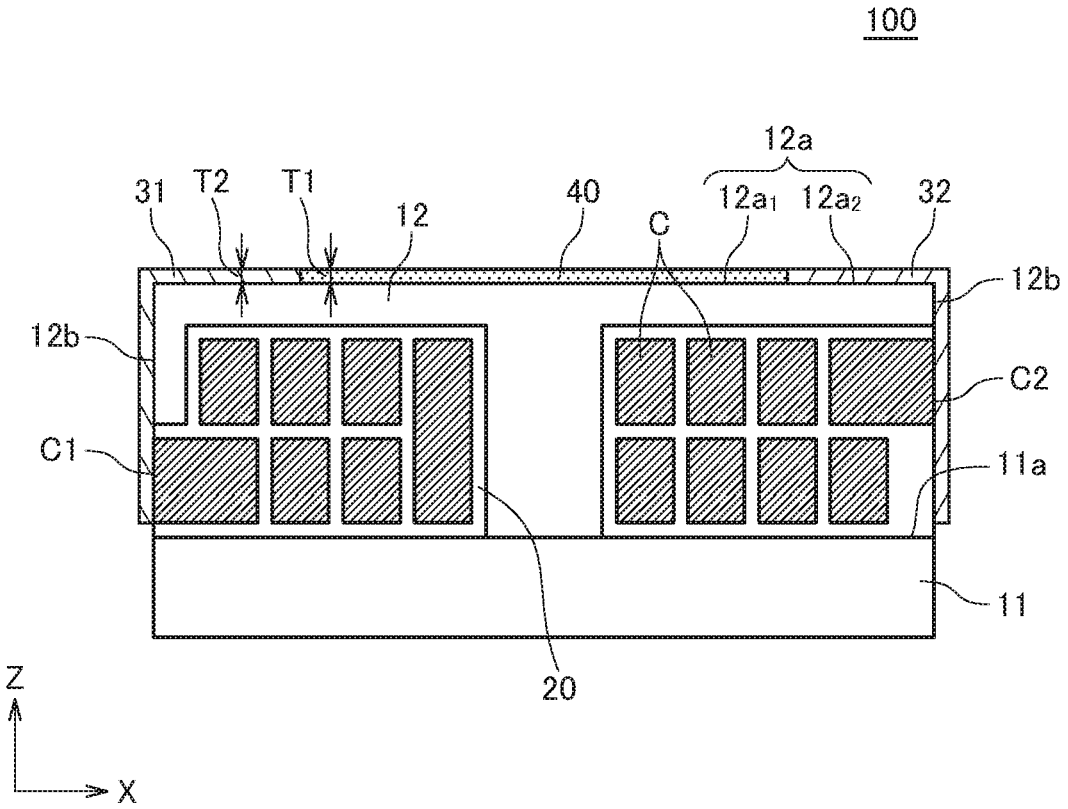
FIG. 2 is a schematic cross-sectional view of the electronic component shown in FIG. 1.

FIG. 1 is a schematic perspective view illustrating the outer appearance of an electronic component 100 according to the first embodiment of the present invention. FIG. 2 is a schematic cross-sectional view of the electronic component 100.

The electronic component 100 according to the present embodiment is a two-terminal type coil component and includes a base 11, a coil pattern C as a passive element part formed on a main surface 11*a* of the base 11, a magnetic resin layer 12 covering the coil pattern C through an insulating resin 20, terminal electrodes 31 and 32 connected respectively to one end C1 and the other end C2 of the coil pattern C, and an insulating coat layer 40 formed on a surface 12*a* of the magnetic resin layer 12.

The base 11 has a plate-like body having the xy plane as the main surface 11*a* and serves as a support body for forming the coil pattern C. The material of the base 11 is not particularly limited, but when the coil pattern C serves as the passive element part as in the present embodiment, the base 11 is preferably a magnetic material such as magnetic resin or ferrite. Although not particularly limited, in the present embodiment, the height of the base 11 in the z-direction is lower than the height of the magnetic resin layer 12 in the z-direction. This is because the back surface of the base 11 is subjected to polishing in a manufacturing process to be described later.

The coil pattern C is made of a good conductor such as copper (Cu) and has eight-turn configuration which is obtained by overlapping two four-turn planar spiral patterns in the z-direction. The one end C1 of the coil pattern C is exposed from a side surface 12*b* of the magnetic resin layer 12 and connected to the terminal electrode 31. Likewise, the other end C2 of the coil pattern C is exposed from the side surface 12*b* of the magnetic resin layer 12 and connected to the terminal electrode 32. As a result, the electronic component 100 according to the present embodiment can be used as a two-terminal type coil component having the two terminal electrodes 31 and 32.

The magnetic resin layer 12 is formed on the main surface 11*a* so as to embed the coil pattern C therein through the insulating resin 20. The magnetic resin layer 12 is made of a composite material obtained by mixing an insulating resin material and a magnetic material such as metal magnetic particles and has comparatively high permeability unlike a general insulating resin. On the other hand, in order to enhance permeability, it is necessary to add a magnetic material having a comparatively large particle diameter, with the result that the surface roughness tends to become larger than that of a general insulating resin. As illustrated in FIG. 2, the magnetic resin layer 12 has a part that covers the upper part of the coil pattern C, a part that is embedded in the inner diameter part of the coil pattern C, and a part provided in the outer peripheral direction of the coil pattern C and constitutes a closed magnetic path together with the base 11.

The magnetic resin layer 12 has a surface 12*a* having the xy plane, a side surface 12*b* having the yz plane, and a side surface 12*c* having the xz plane. The surface 12*a* of the magnetic resin layer 12 has a first area $12a_1$ positioned at substantially the center in the x-direction and a second area $12a_2$ positioned on both sides of the first area $12a_1$ in the x-direction. The insulating coat layer 40 is formed on the first area $12a_1$, and terminal electrodes 31 and 32 are formed on the second area $12a_2$. In the present embodiment, the surface 12*a* of the magnetic resin layer 12 is completely covered with the insulating coat layer 40 and terminal electrodes 31 and 32, and thus the surface 12*a* of the magnetic resin layer 12 is not exposed outside. Although a film thickness T1 of the insulating coat layer 40 and a film thickness T2 of the terminal electrodes 31 and 32 are substantially equal to each other in FIG. 2, this is not essential in the present invention. Thus, the T1 may be set larger or smaller than the T2 according to required characteristics.

The terminal electrode 31 or 32 is formed on the side surface 12*b* of the magnetic resin layer 12. The terminal electrodes 31 and 32 each have an L-shape continuously formed on the surface 12*a* and side surface 12*b* of the magnetic resin layer 12. In FIGS. 1 and 2, the electronic component 100 is put in a posture vertically opposite to that when the electronic component 100 according to the present embodiment is mounted, and when being actually mounted on a substrate, the electronic component 100 is mounted such that the surface 12*a* of the magnetic resin layer 12 faces the substrate. Thus, when the electronic component 100 is mounted on the mounting substrate by soldering, a part of each of the terminal electrodes 31 and 32 that is formed on the surface 12*a* of the magnetic resin layer 12 faces a land pattern on the substrate, and a part of each of the terminal electrodes 31 and 32 that is formed on the side surface 12*b* of the magnetic resin layer 12 is formed with a solder fillet.

The side surface 12*c* of the magnetic resin layer 12 is not covered with the insulating coat layer 40 and terminal electrodes 31 and 32 and is thus completely exposed.

The insulating coat layer 40 is made of a material having higher smoothness than the surface 12*a* of the magnetic resin layer 12 and plays a role of enhancing flowability of underfill after mounting. The smoothness can be defined by surface roughness. That is, the surface roughness of the insulating coat layer 40 is smaller than the surface roughness of the surface 12*a* of the magnetic resin layer 12.

The material of the insulating coat layer 40 is not particularly limited as far as it has higher smoothness than the surface 12*a* of the magnetic resin layer 12 and may be an insulating resin or an inorganic material. Considering the manufacturing cost, it is preferable to use a resin material as the material of the insulating coat layer 40, and an inorganic filler such as silica may be added so as to reduce the thermal expansion coefficient. When the inorganic filler is added, it is preferable to use an inorganic filler having a small particle diameter so as not make the surface roughness of the insulating coat layer 40 exceed the surface roughness of the surface 12*a* of the magnetic resin layer 12. For example, when an inorganic filler having a particle diameter of about 5 μm to 10 μm is added to the insulating coat layer 40, it is possible to ensure sufficiently higher smoothness than the magnetic resin layer 12 containing metal magnetic particles.

As described above, the electronic component 100 according to the present embodiment has the insulating coat layer 40 having high smoothness on the surface thereof facing the substrate at mounting, so that the flowability of underfill is not blocked by the magnetic resin layer 12 having large surface roughness. In addition, the terminal electrodes 31 and 32 are directly formed on the surface 12*a* of the magnetic resin layer 12 having the large surface roughness, so that it is possible to enhance adhesion of the terminal electrodes 31 and 32 by anchor effect.

The following describes a manufacturing method for the electronic component 100 according to the present embodiment.

Figure 3A:
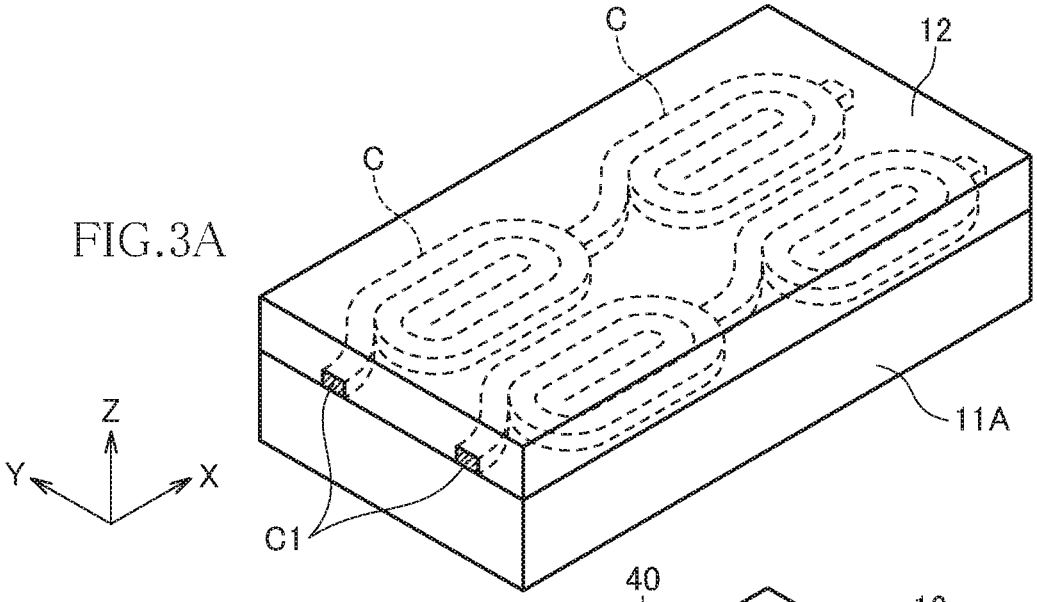
FIGS. 3A-3C and 4A-4C are process diagrams for explaining a manufacturing method for the electronic component shown in FIG. 1.

First, as illustrated in FIG. 3A, a plurality of coil patterns C are formed on the surface of an aggregate substrate 11A, and the magnetic resin layer 12 is formed on the entire surface of the aggregate substrate 11A to thereby embed the coil pattern C therein. The aggregate substrate 11A is a part that finally becomes the base 11 and may have a thickness larger than that of the magnetic resin layer 12 at this time. Although not particularly limited, it is preferable to polish the surface 12*a* of the magnetic resin layer 12 after formation of the magnetic resin layer 12 so as to expose the metal magnetic particles contained in the magnetic resin layer 12.

Figure 3B:
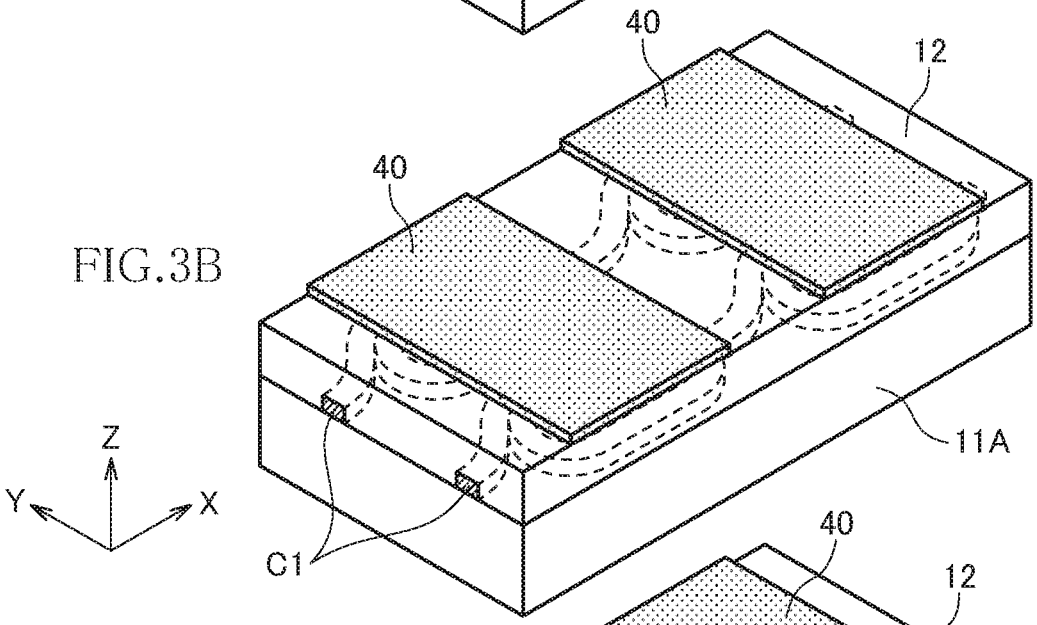

Then, as illustrated in FIG. 3B, the insulating coat layer 40 is formed on the first area $12a_1$ of the surface 12*a* of the magnetic resin layer 12. The formation method for the insulating coat layer 40 is not particularly limited; however, when a resin material is used, a screen printing method is preferable. As a result, on the surface 12*a* of the magnetic resin layer 12, the first area $12a_1$ is covered with the insulating coat layer 40, while the second area $12a_2$ is exposed.

Figure 3C:
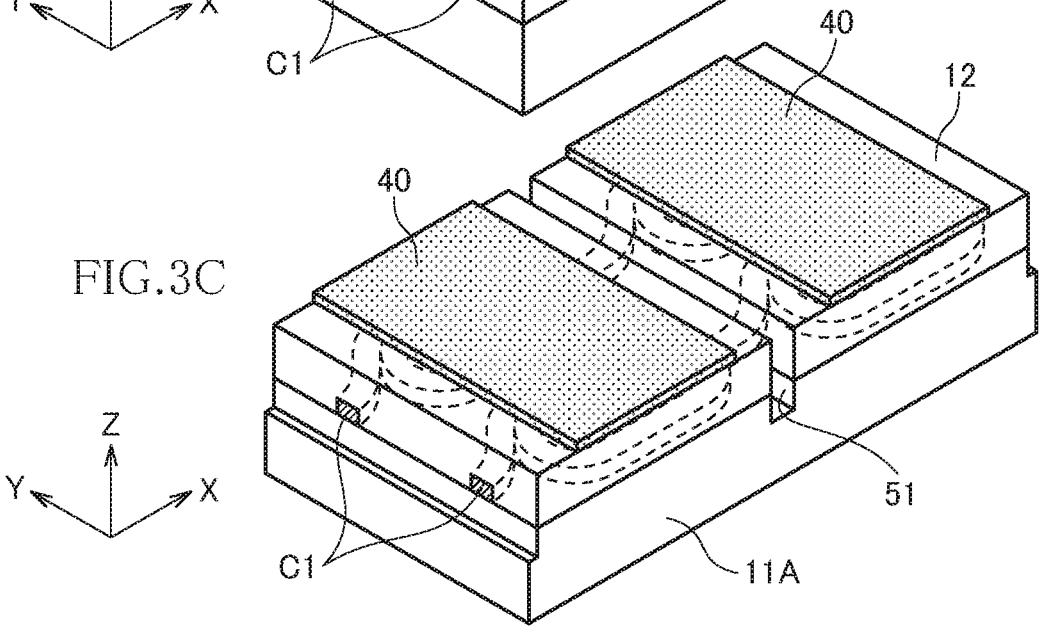

Then, as illustrated in FIG. 3C, a groove 51 extending in the y-direction is formed from the surface 12*a* side of the magnetic resin layer 12 to separate the magnetic resin layer 12 in the x-direction. The groove 51 may be formed by dicing or sand blasting. The groove 51 extends up to the aggregate substrate 11A and, thus, the upper portion of the aggregate substrate 11A is also separated by the groove 51 in the x-direction. In a state where the groove 51 is formed, the side surface 12*b* of the magnetic resin layer 12 and the one and the other ends C1 and C2 of the coil pattern C are exposed to the inner wall of the groove 51. From the side surface 12*b* of the magnetic resin layer 12, the metal magnetic particles contained in the magnetic resin layer 12 are exposed.

Figure 4A:
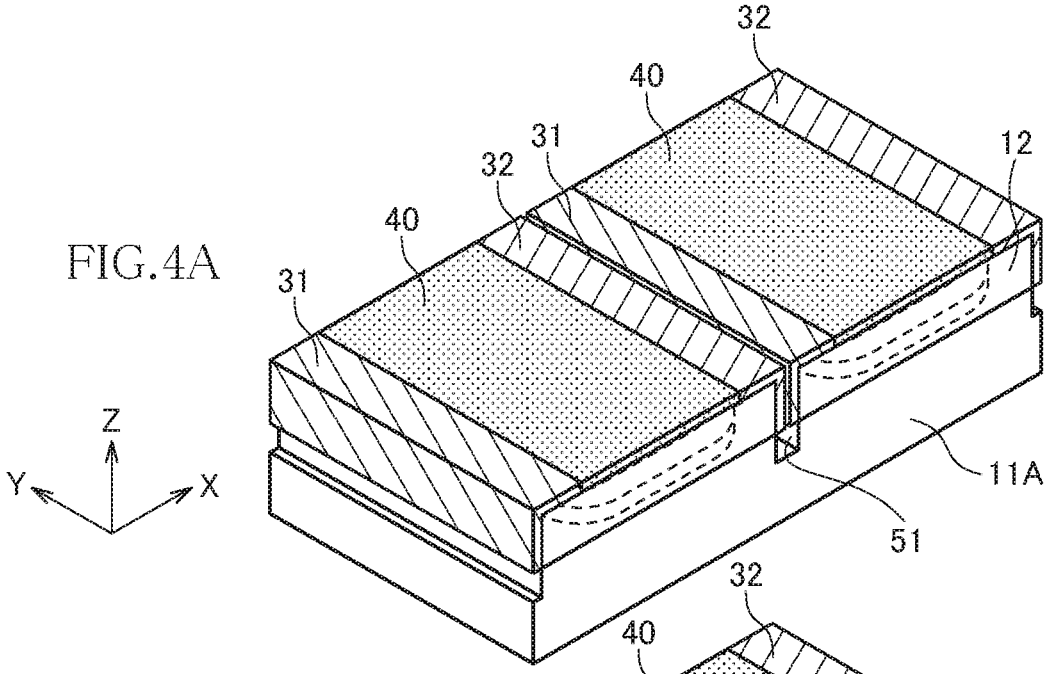

Then, as illustrated in FIG. 4A, electroless plating is applied to form the terminal electrodes 31 and 32 each on the second area $12a_2$ of the surface 12*a* of the magnetic resin layer 12 and the side surface 12*b* thereof. The electroless plating needs to be performed by controlling the composite of plating liquid so as not to form a conductive film on a part that is covered with the insulating coat layer 40 and to selectively form the terminal electrodes 31 and 32 each on the second area $12a_2$ of the surface 12*a* of the magnetic resin layer 12 and the side surface 12*b* thereof. Actually, a plating film is very easily formed on the surface 12*a* and side surface 12*b* of the magnetic resin layer 12 due to large surface roughness of the surface 12*a* and side surface 12*b* and due to exposure of the metal magnetic particles from the surface 12*a* and side surface 12*b*, while a plating film is hardly formed on the surface of the insulating coat layer 40 due to high smoothness of the surface of the insulating coat layer 40. As a result, the terminal electrodes 31 and 32 connected respectively to the one and the other ends C1 and C2 of the coil pattern C are completed.

Figure 4B:
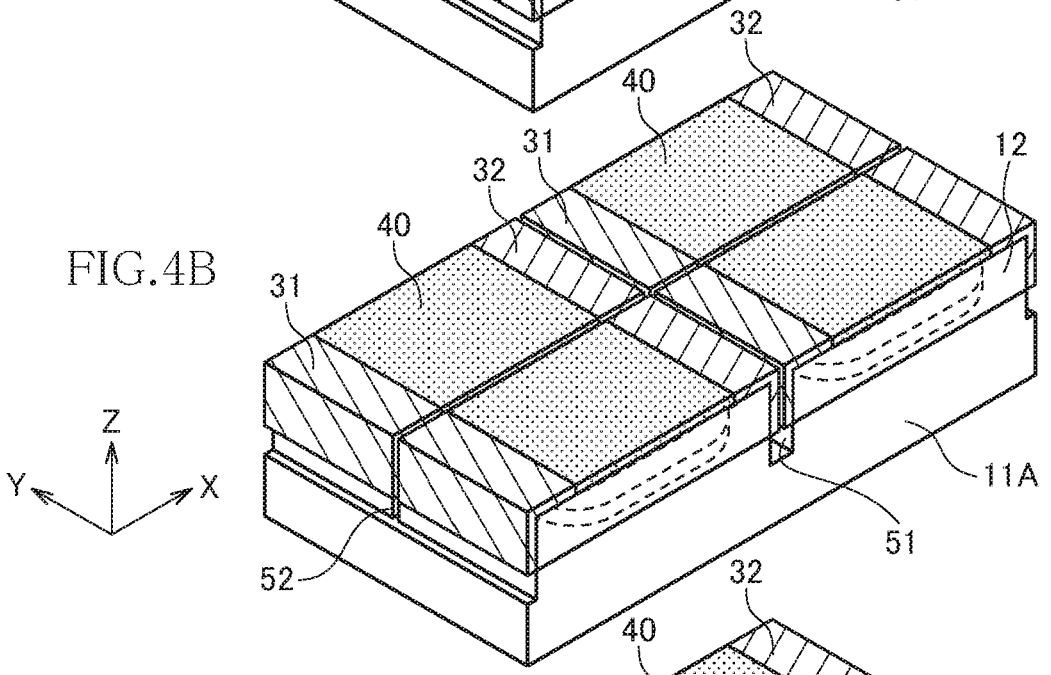

Then, as illustrated in FIG. 4B, a groove 52 extending in the x-direction is formed from the surface 12*a* side of the magnetic resin layer 12 to separate the magnetic resin layer 12 in the y-direction. The groove 52 may be formed by dicing or sand blasting. The groove 52 extends up to the aggregate substrate 11A and, thus, the upper portion of the aggregate substrate 11A is also separated by the groove 52 in the y-direction. In a state where the groove 52 is formed, the side surface 12*c* of the magnetic resin layer 12 is exposed to the inner wall of the groove 52.

Figure 4C:
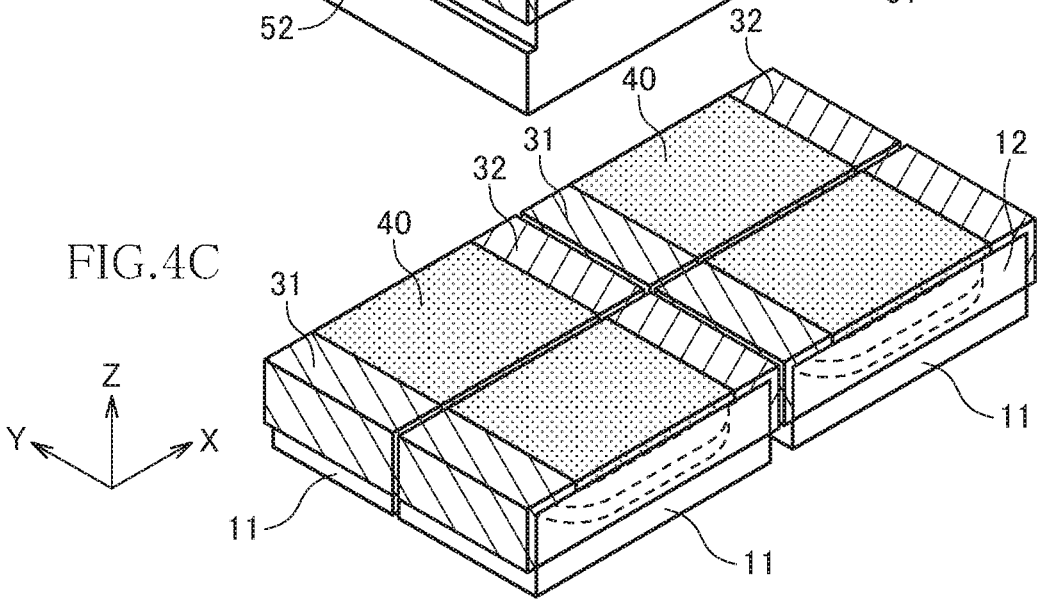

Then, as illustrated in FIG. 4C, the aggregate substrate 11A is polished from the back surface side thereof until the grooves 51 and 52 are exposed to divide the aggregate substrate 11A into individual substrates, whereby multiple electronic components 100 can be obtained.

Thus, according to the manufacturing method for the electronic component 100 according to the present embodiment, the terminal electrodes 31 and 32 are formed by the electroless plating using the insulating coat layer 40 as the mask, so that it is possible to simultaneously form the terminal electrodes 31 and 32 each on the surface 12*a* and side surface 12*b* of the magnetic resin layer 12 in one process. That is, the insulating coat layer 40 plays two roles of serving as the mask for electroless plating during the manufacturing process and enhancing the flowability of underfill after completion of the electronic component 100.

Figure 5:
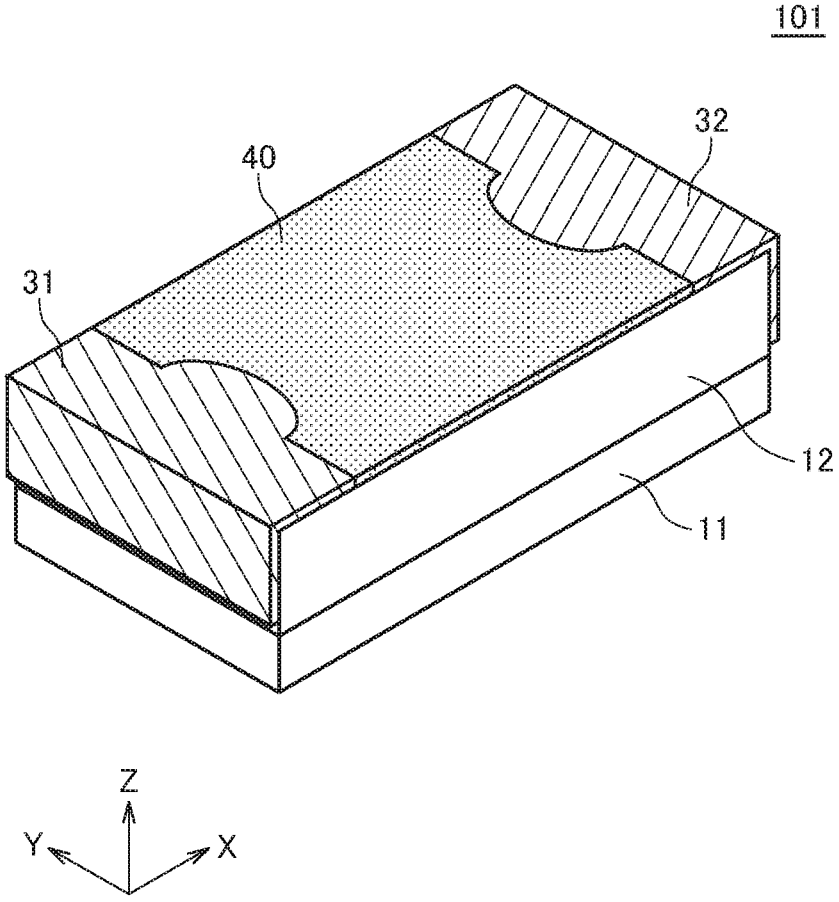
FIG. 5 is a schematic perspective view illustrating the outer appearance of an electronic component according to a first modification of the first embodiment.

FIG. 5 is a schematic perspective view illustrating the outer appearance of an electronic component 101 according to the first modification of the present embodiment. In the electronic component 101 according to the first modification, the edges of the respective terminal electrodes 31 and 32 protrude to the insulating coat layer 40 side, whereby the areas of the respective terminal electrodes 31 and 32 are increased. As exemplified by the present modification, the boundary between the terminal electrodes 31, 32 and insulating coat layer 40 need not be linear, but the edges of the respective terminal electrodes 31 and 32 may be made to protrude to the insulating coat layer 40 side to thereby increase the areas of the respective terminal electrodes 31 and 32. This increases the contact area between the terminal electrodes 31, 32 and a land pattern formed on the mounting substrate, thereby making it possible to reduce connection resistance at the terminal part can be reduced and to enhance mounting strength.

Figure 6:
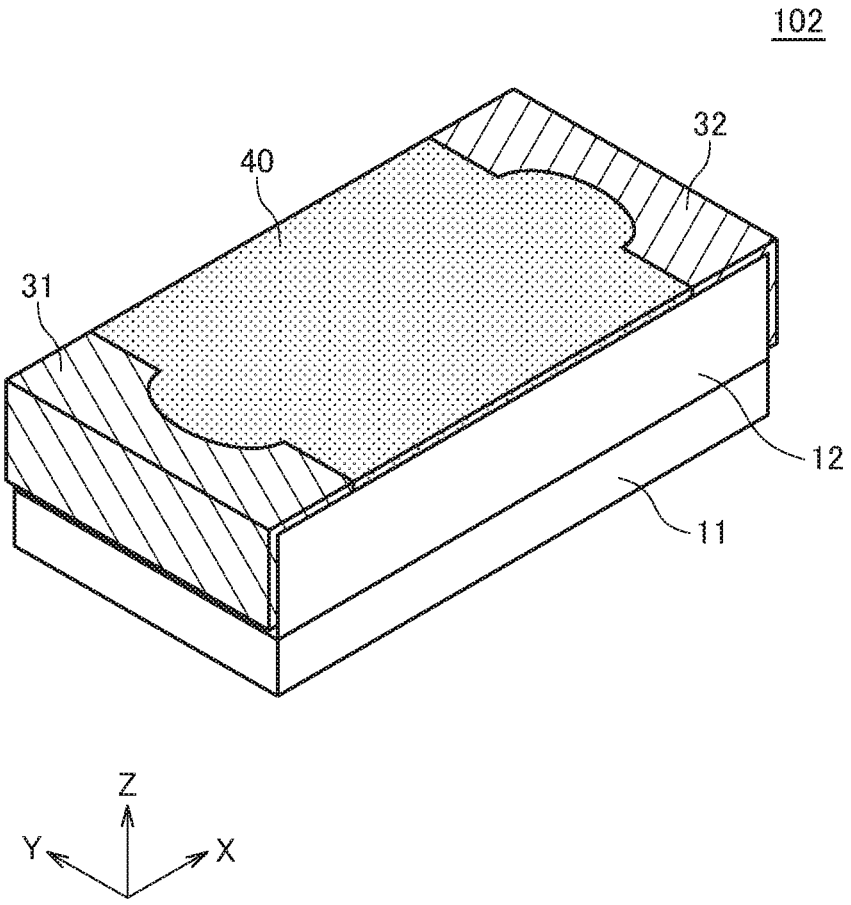
FIG. 6 is a schematic perspective view illustrating the outer appearance of an electronic component according to a second modification of the first embodiment.

FIG. 6 is a schematic perspective view illustrating the outer appearance of an electronic component 102 according to the second modification of the present embodiment. In the electronic component 102 according to the second modification, the edges of the insulating coat layer 40 protrude respectively to the sides of the terminal electrodes 31 and 32, whereby the areas of the respective terminal electrodes 31 and 32 are reduced. This can reduce an eddy current generated due to interlinkage of magnetic flux generated from the coil pattern C with the terminal electrodes 31 and 32.

Figure 7:
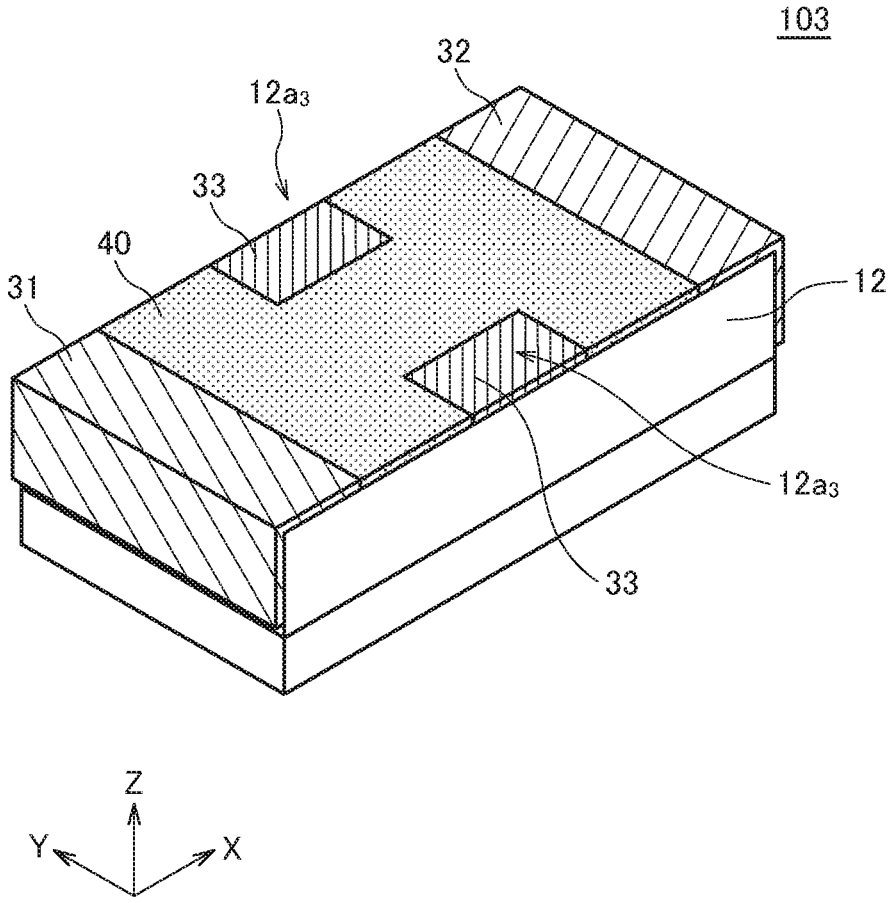
FIG. 7 is a schematic perspective view illustrating the outer appearance of an electronic component according to a third modification of the first embodiment.

FIG. 7 is a schematic perspective view illustrating the outer appearance of an electronic component 103 according to the third modification of the present embodiment. In the electronic component 103 according to the third modification, two electrode terminals 33 are additionally formed respectively in third areas $12a_3$ of the surface 12*a* of the magnetic resin layer 12. The two terminal electrodes 33 are separated from the terminal electrodes 31 and 32 in a plan view and disposed along the side extending in the x-direction in the example of FIG. 7. The terminal electrodes 33 may be electrically connected or not connected to the passive element part such as the coil pattern C. When being not connected to the passive element part, the terminal electrodes 33 are used as dummy electrodes and play a role of enhancing mounting strength and heat radiation performance. The arrangement of the terminal electrodes 33 is not limited to that illustrated in FIG. 7, and a single terminal electrode 33 may be disposed at the center portion of the surface 12*a* of the magnetic resin layer 12 so as to be surrounded by the insulating coat layer 40 in a plan view.

Second Embodiment

Figure 8:
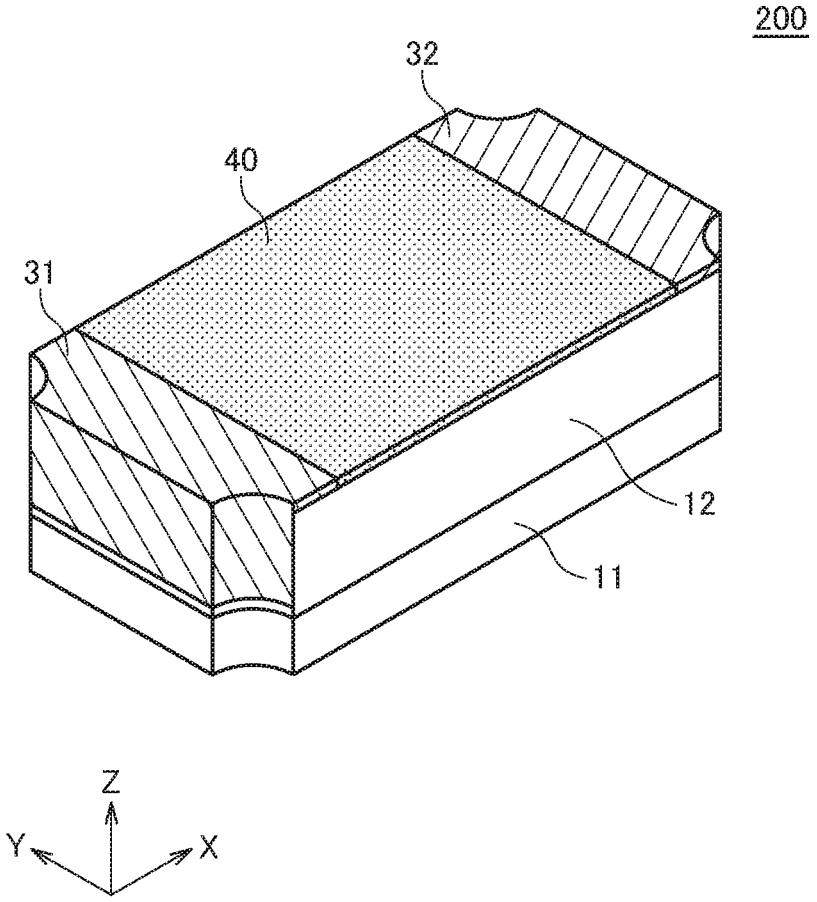
FIG. 8 is a schematic perspective view illustrating the outer appearance of an electronic component according to a second embodiment of the present invention.

FIG. 8 is a schematic perspective view illustrating the outer appearance of an electronic component 200 according to the second embodiment of the present invention.

As illustrated in FIG. 8, the electronic component 200 according to the second embodiment has a configuration in which the corners of the magnetic resin layer 12 are removed in an arc, and the terminal electrodes 31 and 32 are formed on the inner walls of the removed portions. Other configurations are the same as those of the electronic component 100 according to the first embodiment, so the same reference numerals are given to the same elements, and overlapping description will be omitted.

In the electronic component 200 according to the second embodiment, the terminal electrodes 31 and 32 are formed not only on the xy plane and yz plane, but also on the inner walls of the arc-like corners of the magnetic resin layer 12, so that solder fillet spreads wider than in the first embodiment. This can further enhance mounting strength onto the substrate.

Figure 9:
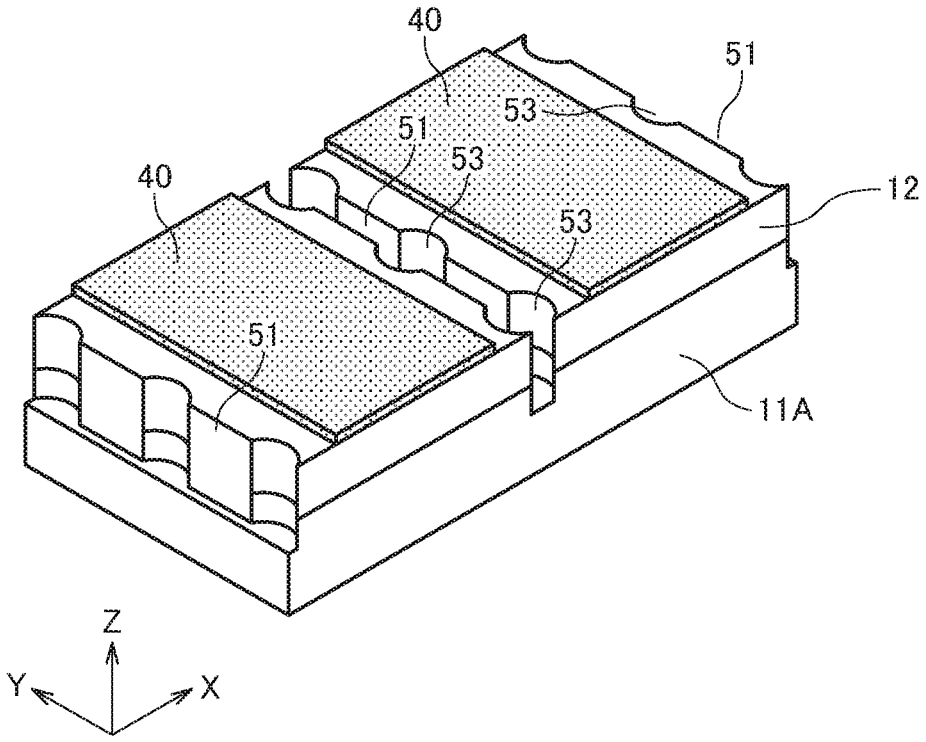
FIG. 9 is process diagram for explaining a manufacturing method for the electronic component shown in FIG. 8.

A manufacturing method for the electronic component 200 according to the second embodiment is as follows. After the processes described using FIGS. 3A and 3B, the groove 51 extending in the y-direction is formed, and circular grooves 53 are formed at positions corresponding to the corners of the electronic component 200, as illustrated in FIG. 9. The grooves 51 and 53 can be formed simultaneously by sand blasting. Alternatively, a method may be adopted, in which the groove 51 is formed by dicing and, then, the groove 53 is formed using a drill. After that, by performing the processes described using FIGS. 4A to 4C, the electronic component 200 according to the second embodiment is completed. As described above, by forming the groove 53 in the magnetic resin layer 12 before the formation of the terminal electrodes 31 and 32 using the electroless plating, a part of each of the terminal electrodes 31 and 32 can be formed on the inner wall of the groove 53.

Figure 10:
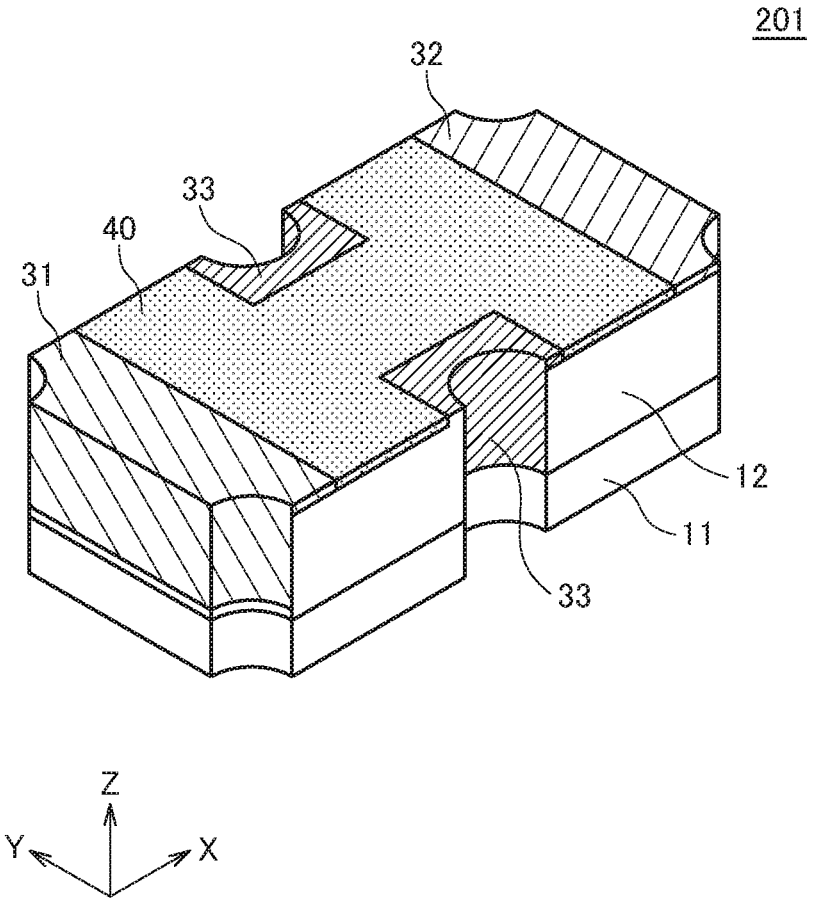
FIG. 10 is a schematic perspective view illustrating the outer appearance of an electronic component according to a modification of the second embodiment.

FIG. 10 is a schematic perspective view illustrating the outer appearance of an electronic component 201 according to a modification of the present embodiment. In the electronic component 201 according to the modification, grooves are formed also in the respective side surfaces 12*c* of the magnetic resin layer 12, and two terminal electrodes 33 are additionally formed on the inner walls of the respective grooves. As described above in the modification illustrated in FIG. 7, the terminal electrodes 33 may be electrically connected or not connected to the passive element part such as the coil pattern C. By thus forming the groove in the side surface 12*c* of the magnetic resin layer 12, the terminal electrode 33 can be formed also on the side surface 12*c* of the magnetic resin layer 12.

It is apparent that the present invention is not limited to the above embodiments, but may be modified and changed without departing from the scope and spirit of the invention.

For example, in the above embodiments, the coil pattern C serving as the passive element part has an eight-turn spiral pattern; however, the spiral pattern shape of the passive element part is not limited to this.

What is claimed is:

1. An electronic component comprising:

a base having a main and a third side surface substantially perpendicular to the main surface;

a passive element part formed on the main surface of the base;

a magnetic resin layer formed on the main surface of the base so as to embed the passive element part therein, the magnetic resin layer having a top surface extending substantially parallel to the main surface of the base and a first side surface substantially perpendicular to the main surface of the base;

an insulating coat layer formed on a first area of the top surface of the magnetic resin layer, the insulating coat layer having higher smoothness than the top surface of the magnetic resin layer; and a terminal electrode continuously and directly formed on a second area of the top surface of the magnetic resin layer and the first side surface of the magnetic resin layer and electrically connected to the passive element part, wherein the magnetic resin layer comprises different material from the base, wherein the base is free from the terminal electrode, wherein a thickness of the terminal electrode formed on the second area of the top surface of the magnetic resin layer is substantially a same as a thickness of the terminal electrode formed on the first side surface of the magnetic resin layer, and wherein the first side surface of the magnetic resin layer and the third side surface of the base are substantially coplanar with each other, whereby the terminal electrode formed on the first side surface of the magnetic resin layer protrudes from the base.

2. The electronic component as claimed in claim 1, wherein the insulating coat layer contains insulating resin.

3. The electronic component as claimed in claim 2, wherein the insulating coat layer further contains inorganic filler.

4. The electronic component as claimed in claim 1, wherein the magnetic resin layer contains metal magnetic particles.

5. The electronic component as claimed in claim 1, wherein the top surface of the magnetic resin layer is completely covered with the terminal electrode or the insulating coat so as not to be exposed.

6. The electronic component as claimed in claim 1, wherein the magnetic resin layer further has a second side surface substantially perpendicular to both the main surface of the base and the first side surface, and wherein the second side surface of the magnetic resin layer is completely exposed without being covered with the terminal electrode.

7. The electronic component as claimed in claim 1, wherein the terminal electrode includes first and second terminal electrodes, wherein the passive element part includes a coil pattern, and wherein one and other ends of the coil pattern are connected respectively to the first and second terminal electrodes.

8. The electronic component as claimed in claim 7, wherein the terminal electrode further includes a third terminal electrode formed in a third area of the surface of the magnetic resin layer.

9. The electronic component as claimed in claim 1, wherein a film thickness of the terminal electrode and a film thickness of the insulating coat layer differs from each other.

10. The electronic component as claimed in claim 1, wherein a thickness of the insulating coat layer is substantially a same as a thickness of the terminal electrode formed on the second area of the top surface of the magnetic resin layer.

11. The electronic component as claimed in claim 1, wherein the insulating coat layer is thinner than the magnetic resin layer.

12. The electronic component as claimed in claim 11, wherein the insulating coat layer is thinner than the base.

13. The electronic component as claimed in claim 12, wherein the first side surface of the magnetic resin layer is flat.

* * * * *